US008915807B1

(12) United States Patent
Olson et al.

(10) Patent No.: US 8,915,807 B1
(45) Date of Patent: Dec. 23, 2014

(54) SLIDE HAMMER IMPACT ENHANCEMENT SYSTEM

(71) Applicants: Brian K. Olson, Colfax, WI (US); Wade D. Gilbert, Chippewa Falls, WI (US)

(72) Inventors: Brian K. Olson, Colfax, WI (US); Wade D. Gilbert, Chippewa Falls, WI (US)

(73) Assignee: New Age Archery Products LLC, Colfax, WI (US)

( * ) Notice: Subject to any disclaimer, the term of this patent is extended or adjusted under 35 U.S.C. 154(b) by 0 days.

(21) Appl. No.: 13/970,643

(22) Filed: Aug. 20, 2013

Related U.S. Application Data

(60) Provisional application No. 61/700,595, filed on Sep. 13, 2012.

(51) Int. Cl.
*F42B 6/04* (2006.01)

(52) U.S. Cl.
CPC ..... *F42B 6/04* (2013.01)
USPC ..... 473/578

(58) Field of Classification Search
USPC ..... 473/578
See application file for complete search history.

(56) References Cited

U.S. PATENT DOCUMENTS

| | | | |
|---|---|---|---|
| 4,489,949 | A | 12/1984 | Taylor et al. |
| 4,900,038 | A | 2/1990 | Czetto et al. |
| 6,375,586 | B1 | 4/2002 | Cousins et al. |
| 6,558,280 | B1 | 5/2003 | Kuhn |
| 8,241,157 | B2 | 8/2012 | Russell et al. |
| 2006/0154756 | A1 | 7/2006 | Shao |

*Primary Examiner* — John Ricci
(74) *Attorney, Agent, or Firm* — Tipton L. Randall

(57) ABSTRACT

A slide hammer impact enhancement system adapted for incorporation into a hollow arrow shaft comprises a weight member movably positioned within the hollow arrow shaft with a magnet member rigidly secured to an end thereof. A nock member is rigidly mounted at one end of the hollow arrow shaft, and contains an attachment member accessible from within the hollow arrow shaft. The magnet member and attached weight member are maintained adjacent the nock member by the attachment member upon launching the arrow. Upon the arrow striking a target, the magnet member and connected weight member disengage from the attachment member, move down the hollow arrow shaft, and strike an arrow head at the opposite end thereof, thereby further driving the arrow into the target.

12 Claims, 7 Drawing Sheets

42
10
40

15
45
30
25
20
17

SLIDE HAMMER IMPACT ENHANCEMENT SYSTEM

CROSS-REFERENCE TO RELATED APPLICATIONS, IF ANY

This application claims the benefit under 35 U.S.C. §119 (e) of provisional application Ser. No. 61/700,695, filed 13 Sep. 2012. Application Ser. No. 61/700,695 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to bow hunting and, more particularly, to a device for improving penetration of an arrow into a target and, most particularly, to a slide hammer impact enhancement system for an arrow used for bow hunting.

2. Background Information

A number of inventions concerned with impact enhancement devices for arrows have been granted patents. Taylor et al., in U.S. Pat. No. 4,489,949, describe an "improved" arrow construction which, by the partial or complete elimination of tail feathers as a means for stabilizing flight trajectory, improves both the speed and the accuracy of the arrow. A resilient stabilizing tail is substituted for tail feathers which substantially eliminates aerodynamic drag. In addition, the invention contemplates the use of a "shock piston" within the interior of the arrow shaft, which serves to increase arrow penetration in the target by striking the arrow head after the initial target impact. The enlarged head of the "shock piston" includes an elongated stabilizer that moves through a channel in the nock. The stabilizer is positioned within the arrow when launched, moves rearward out of the nock, then moves back inside the arrow when it hits the target.

In U.S. Pat. No. 4,900,038, Czetto et al. disclose an arrow projectile comprising an elongated, linearly configured body, having a hollow interior portion extending along the length thereof and preferably having a pointed, closed first end and an oppositely disposed second end which may have fletchings, as in typical arrow construction. Kinetic energy transferring members are captivated within the hollow interior portion of the body and movable between a first portion adjacent the rear end upon initial flight of projectile from a projecting device and transferable toward the leading end to a second position of impact so as to cause successive bursts or thrusts occurring as the energy transferring slide member impacts upon the leading end of the body and one another. The interior of the arrow shaft includes multiple sets of stationary magnets (36, 38; 44, 46; etc.) with a magnetically attracted weight (30, 32, 34) positioned between the magnet sets. The weights are complex in shape to minimize friction with the interior of the arrow shaft.

U.S. Pat. No. 6,375,586, by Cousins et al., discloses a device to increase an arrow's kinetic energy, and hence the force on target impact, without a substantial decrease in the velocity of the arrow as compared to the same arrow without such devices. The impact-enhancing devices are insertable into an arrow shaft and include an impact-enhancer weight (28) which is freely moveable within the arrow shaft, with the weight (28) sliding on a central guide shaft a (24). The impact-enhancer weight will thus be propelled in response to rapid deceleration of the arrow (i.e., caused by the arrow head striking a target area). The relatively high velocity movement of the impact-enhancer weight will create a secondary kinetic energy effect which drives the arrow head further into the target area. That is, the impact-enhancer weight will be propelled forward at a sufficiently high velocity and strike a rearward region adjacent the arrow head, thereby generating a secondary impact force (i.e., secondary to the initial target impact of the arrow itself) causing the arrow head to penetrate deeper into the target area. In such a manner, the effect of the arrow head is enhanced.

Kuhn, in U.S. Pat. No. 6,588,280, describes a cylindrical arrow ferrule device that is inserted between the arrowhead and the main shaft of an arrow or as an integral part of a hollow arrow shaft. A key feature of the invention is an internal actuator that slides down an inner chamber of the device. Prior to impact, the actuator is magnetically coupled to the aft wall of the chamber; but, upon impact, the resulting force releases the actuator that then slides forward to impact the forward wall of the chamber. This actuation provides the same inelastic collision associated with a dead-blow hammer, thereby driving the arrow into the target.

In U.S. Pat. No. 8,241,157, Russell et al. disclose a projectile system that includes a hollow portion with a weight that is movably secured within the hollow portion of the projectile insert system. Some embodiments include an attracting device, rigidly secured at a first end of the hollow portion, with the attracting device removably securing the weight, where the hollow portion provides a pathway for the weight to travel when a force is exerted on the projectile insert system that causes the weight to become unsecured from the attracting device. In all examples and drawings, the attaching device (106, 208 or 308), which is a magnet, is secured in a stationary position. Only the weight moves on impact, not the magnet.

Shao, in U.S. Patent No. 2006/0154756 describes a dart having a substantially hollow shaft and one or a plurality of removable weights to be placed in the lumen of the shaft so that the weight of the dart is adjustable. This results in a secondary momentum when the dart hits a dartboard. The weight can be magnetic or nonmagnetic.

Applicants have invented a slide hammer impact enhancement system for an arrow that is easily incorporated into commercially available arrows. The impact enhancement system of the present invention is inexpensive, reusable, and readily transferred between arrows should other portions of the arrow be damaged. The slide hammer impact enhancement system is a novel improvement over the existing technology in this field of art.

SUMMARY OF THE INVENTION

The invention is directed to a slide hammer impact enhancement system for an arrow. Nearly all arrows commercially available today contain a hollow shaft fabricated from carbon fiber composite. The composite material is light weight and extremely strong. The slide hammer impact enhancement system is designed for incorporation into such hollow shaft arrows. The slide hammer impact enhancement system is composed of two elements. A cylindrical metallic member includes a tapered end section with a small, cylindrical magnet positioned at the tapered end section and in alignment with the cylindrical axis of the metallic member.

The arrow nock member, which fits snugly into one end of the hollow shaft of an arrow, contains a slot that accepts the bow string. The opposite end of the arrow nock member, fitted inside the hollow shaft of the arrow, contains an aperture with an attachment member positioned therein. The cylindrical magnet of the cylindrical metallic member fits against the attachment member of the arrow nock member.

Preferably, the cylindrical metallic member is fabricated from high grade aluminum, precision machined to slidably fit inside the hollow shaft of an arrow. The aluminum is hardened by a spark anodization process, which deposits a thin layer of aluminum oxide onto the surface of the metallic member, thereby preventing distortion of the metallic member, as detailed below.

The slide hammer impact enhancement system is incorporated into a commercially available arrow by removing the nock member, securing the attachment member within the nock member, inserting the cylindrical metallic member into the hollow shaft with the cylindrical magnet adjacent the open end of the shaft, and securing the arrow nock member with attachment member therein snugly into the end of the hollow shaft of an arrow. The resulting arrow is inclined upward from the nock member so the tapered end of the cylindrical metallic member holding the cylindrical magnet encounters the attachment member within the nock, thereby holding the cylindrical metallic member close to the nock member, regardless of the orientation of the arrow. In one embodiment of the invention, the attachment member comprises a magnetically susceptible material that is magnetically attracted to the magnet. Preferably, the attachment member comprises a second magnet member positioned within the nock member to magnetically attract the first magnet member.

When the arrow strikes a target, the deceleration of the arrow causes the magnet member of the cylindrical metallic member to disengage from the attachment member of the nock member, moving the cylindrical metallic member down the hollow shaft of the arrow and impacting the end of the shaft holding the arrow head. This provides additional force to further drive the arrow head into the target. The above-described spark anodization treatment of the metallic member prevents distortion of the metallic member upon impact with the arrow head positioned at the end of the shaft, enabling the metallic member to be reused multiple times before replacement is required. Inclining the arrow with the arrow head elevated allows the metallic member to slide back toward the nock member and the magnet member again engages the attachment member, as described above.

In the broadest embodiment of the invention, the slide hammer impact enhancement system is adapted for incorporation into a hollow arrow shaft. The slide hammer impact enhancement system comprises a weight member adapted for movable positioning within the hollow arrow shaft. A magnet member is rigidly attached to an end of the weight member. A nock member is adapted for rigid mounting at a first end of the hollow arrow shaft. The nock member includes an attachment member accessible from within the hollow arrow shaft. In use, the magnet member and attached weight member within the hollow arrow shaft are maintained adjacent the nock member by the attachment member upon launching the arrow. Upon the arrow striking a target, the magnet member and attached weight member disengage from the attachment member, move down the hollow arrow shaft, and strike the arrow head at a second opposite end thereof, thereby further driving the arrow into the target.

DESCRIPTION OF THE EMBODIMENTS

Nomenclature

Figure 1:
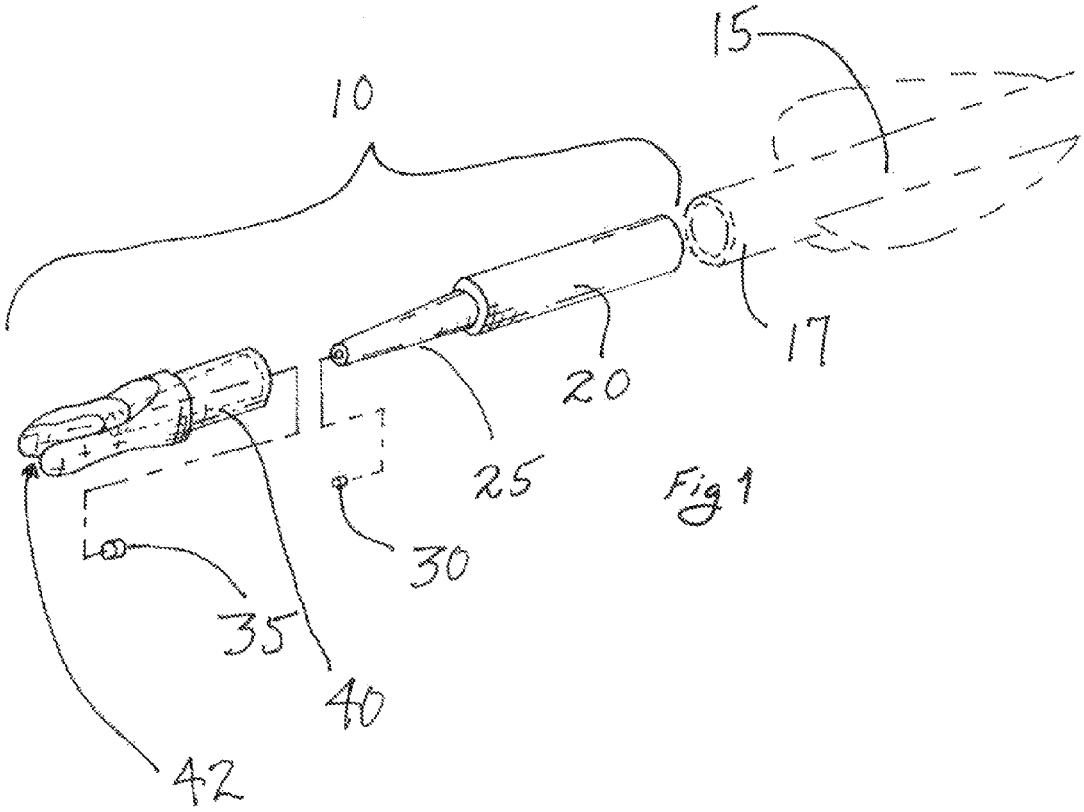
FIG. 1 is a perspective, exploded view of the slide hammer impact enhancement system of the present invention adapted for positioning within a first end of a hollow arrow shaft.
Figure 2:
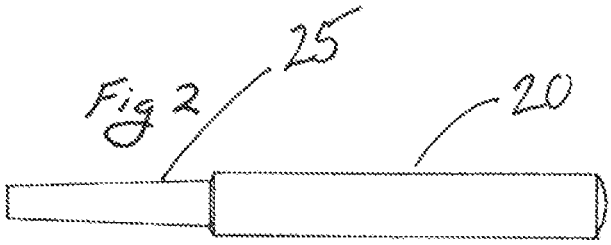
FIG. 2 is a side perspective view of the weight member of the slide hammer impact enhancement system of the present invention.
Figure 3:
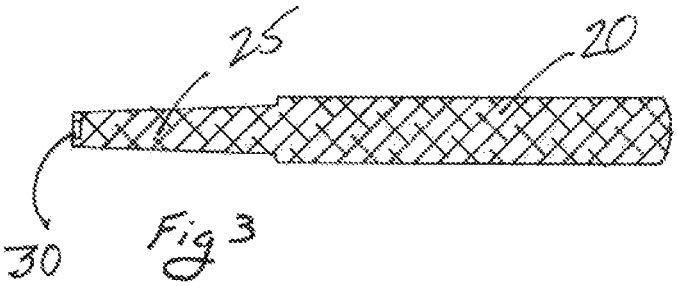
FIG. 3 is a cross sectional view of the weight member and magnet member of the slide hammer impact enhancement system of the present invention.
Figure 4:
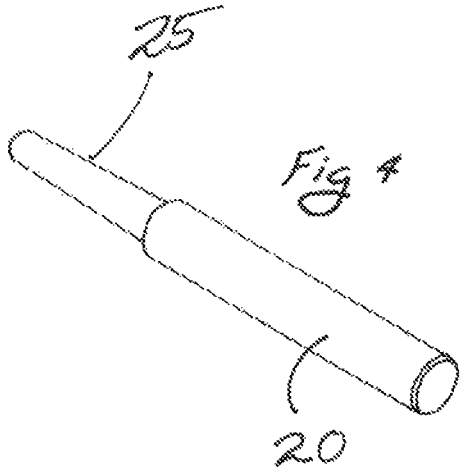
FIG. 4 is another perspective view of the weight member of the slide hammer impact enhancement system of the present invention.
Figure 5:
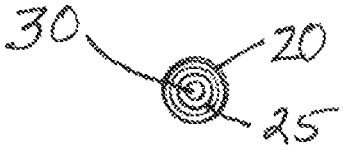
FIG. 5 is an end view of the weight member and magnet member of the slide hammer impact enhancement system of the present invention.

10 Slide Hammer Impact Enhancement System
15 Hollow Arrows Shaft
17 First End of Hollow Arrow Shaft
18 Second End of Hollow Arrow Shaft
19 Arrow Head Member
20 Weight Member
25 Tapered End of Weight Member
30 First Rare Earth Magnet Member
35 Second Rare Earth Magnet Attachment Member
40 Nock Member
42 Slot in Nock Member for Bow String
45 Magnetically Susceptible Attachment Member Construction The invention is a slide hammer impact enhancement system for an arrow. Nearly all arrows commercially available today contain a hollow shaft fabricated from carbon fiber composite. The composite material is light weight and extremely strong. The slide hammer impact enhancement system is designed for incorporation into such hollow shaft arrows. The slide hammer impact enhancement system is composed of two elements. A cylindrical metallic member includes a tapered end section with a small, cylindrical magnet extending from the tapered end section and in alignment with the cylindrical axis of the metallic member. The arrow nock member, which fits snugly into one end of the hollow shaft of an arrow, contains a slot that accepts the bow string. The end of the arrow nock member, fitted inside the hollow shaft of the arrow, contains an aperture with a magnetically susceptible member positioned therein. The cylindrical magnet of the cylindrical metallic member fits against the attachment member of the arrow nock member.

Preferably, the cylindrical metallic member is fabricated from high grade aluminum, precision machined to slidably fit inside the hollow shaft of an arrow. The aluminum is hardened by a spark anodization process, well known in the industry, and also termed anodic oxidation by spark discharge. Spark anodization deposits a thin layer of aluminum oxide onto the surface of the metallic member, thereby preventing distortion of the metallic member, as detailed below.

The slide hammer impact enhancement system is incorporated into a commercially available arrow by removing the nock member, securing the attachment member within the nock member, inserting the cylindrical metallic member into the hollow shaft with the cylindrical magnet adjacent the open end of the shaft, and securing the arrow nock member with the attachment member therein snugly into the end of the hollow shaft of an arrow. The resulting arrow is inclined upward from the nock member so the tapered end of the cylindrical metallic member holding the cylindrical magnet encounters the attachment member within the nock, thereby holding the cylindrical metallic member close to the nock member, regardless of the orientation of the arrow. In one embodiment of the invention, the attachment member comprises a magnetically susceptible material that is magnetically attracted to the magnet. Preferably, the attachment member comprises a second magnet member positioned within the nock member to magnetically attract the first magnet member.

When the arrow strikes a target, the deceleration of the arrow causes the magnet member of the cylindrical metallic member to disengage from the attachment member of the nock member, move down the hollow shaft of the arrow and impact the end of the shaft holding the arrow head. This provides additional force to further drive the arrow head into the target. The above-described spark anodization treatment of the metallic member prevents distortion of the metallic member upon impact with the arrow head positioned at the end of the shaft, enabling the metallic member to be reused multiple times before replacement is required. Inclining the arrow with the arrow head elevated allows the metallic member to slide back toward the nock member and the magnetic member again engages the attachment member, as described above.

Referring now to FIGS. 1-5, the slide hammer impact enhancement system 10 of the present invention is shown incorporated into a hollow arrow shaft 15. The slide hammer impact enhancement system 10 comprises a weight member 20 movably positioned within a hollow arrow shaft 15. In a preferred embodiment, a cylindrical, metallic weight member 20 has a tapered end 25 and is movably positioned within the hollow arrow shaft 15. Most preferably, the cylindrical portion of the weight member 20 has a diameter of about 0.50 inches, and a length of about 1.50 inches. The tapered end 25 of the weight member 20 has a length of about 0.75 inches. The cylindrical portion of the weight member 20 has a diameter that allows passage of air between the weight member 20 and the interior wall of the hollow arrow shaft 15 as the weight member 20 moves there within.

Most preferably, the weight member 20 is fabricated from aluminum and includes a spark anodized surface treatment to prevent expansion of the cylindrical weight member 20 upon impact. A cylindrical first magnet member 30 is permanently secured to the tapered end 25 of the weight member 20 in alignment with the cylindrical axis of the weight member 20. Preferably the first magnet member 30 is a rare earth magnet, which displays enhanced magnetic properties. Such rare earth magnets 30 are available as Magcraft Rare Earth Magnets from National Imports, Vienna, Va.

Figure 9:
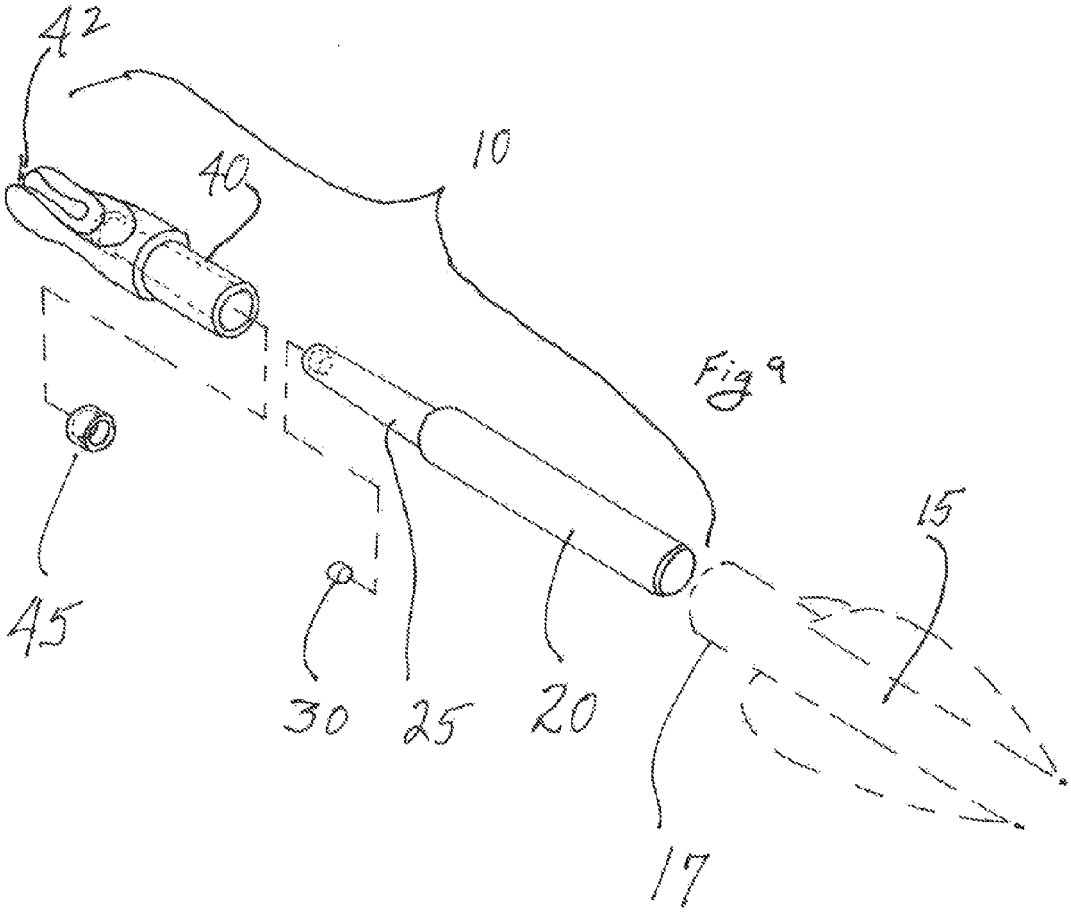
FIG. 9 is a perspective, exploded view of an alternative embodiment of the slide hammer impact enhancement system of the present invention adapted for positioning within a first end of a hollow arrow shaft.

A nock member 40 is rigidly mounted at a first end 17 of the hollow arrow shaft 15 with an attachment member accessible from within the hollow arrow shaft 15. A nock member 40 is generally part of a purchased arrow, although individual nock members 40 are widely available from sporting goods retailers. In one embodiment, shown in FIG. 9, the attachment member comprises a hollow, cylindrical member 45 with a closed end. The cylindrical member 45 is fabricated from a magnetically susceptible material, such as iron or a steel alloy. In another embodiment, shown in FIGS. 1-5, the attachment member comprises a second cylindrical magnet member 35, most preferably a rare earth magnet member 35, which also displays enhanced magnetic properties. Such rare earth magnets 35 are available as Magcraft Rare Earth Magnets from National Imports, Vienna, Va. The second magnet attachment member 35 is mounted within the hollow nock member 40, with the second magnet member 35 accessible from within the hollow arrow shaft 15.

Figure 6:
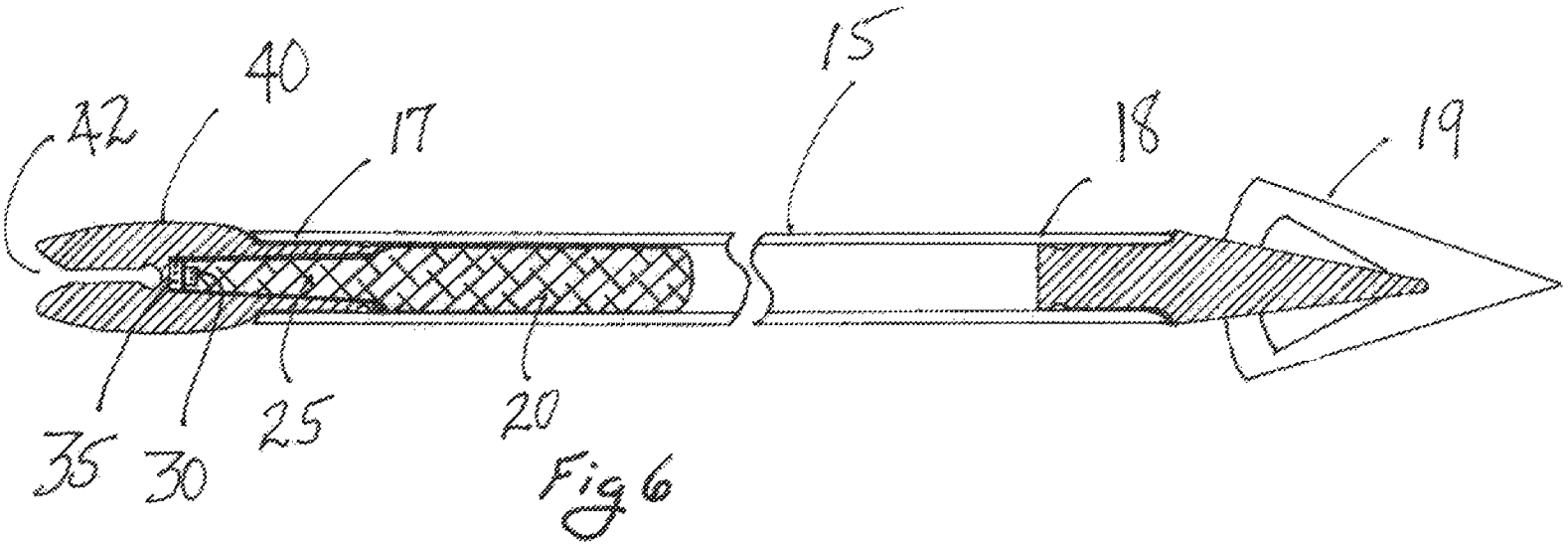
FIG. 6 is a cross sectional view of one embodiment of the slide hammer impact enhancement system of the present invention within the first end of a hollow arrow shaft prior to launching the arrow.
Figure 7:
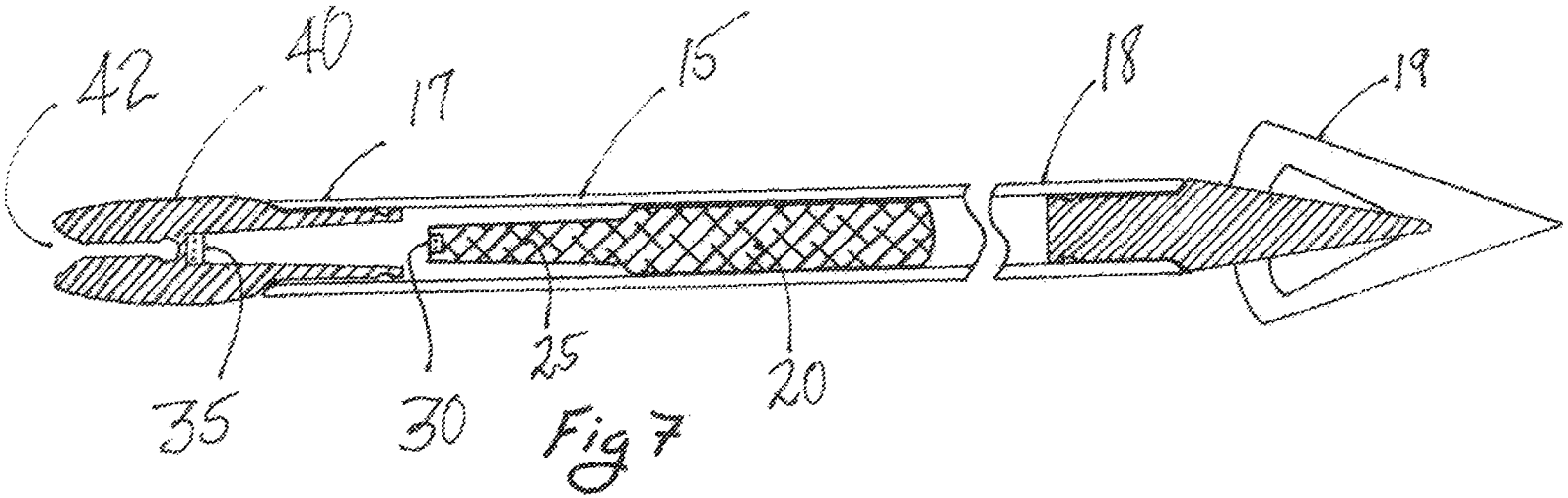
FIG. 7 is a cross sectional view of one embodiment of the slide hammer impact enhancement system of the present invention within the hollow arrow shaft as the arrow strikes the target.
Figure 8:
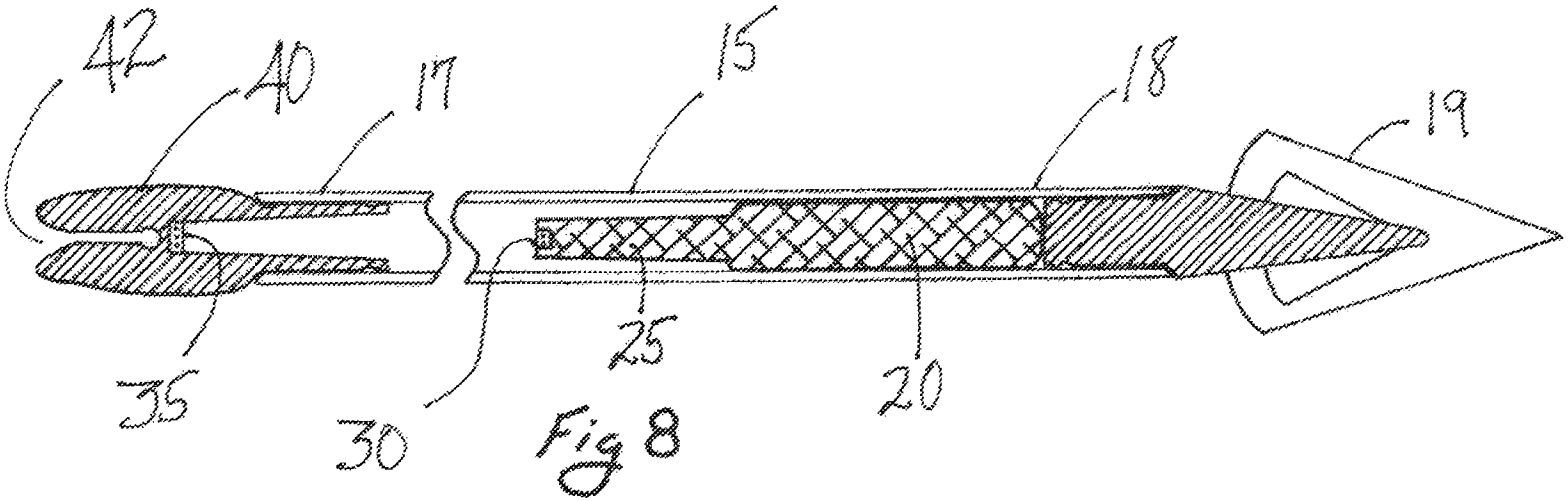
FIG. 8 is a cross sectional view of one embodiment of the slide hammer impact enhancement system of the present invention within the second end of a hollow arrow shaft immediately after striking the target.

Referring now to FIGS. 6-8, in operation, the first magnet member 30 and connected weight member 20 within the hollow arrow shaft 15 is maintained adjacent the nock member 40 by attraction to the second magnet attachment member 35 upon launching the arrow. Upon the arrow striking a target, the first magnet member 30 and connected weight member 20 disengage from the second magnet attachment member 35, and move down the hollow arrow shaft 15 striking the arrow head member 19 at the opposite second end 18 thereof, thereby further driving the arrow into the target.

In some instances, an arrow insert is rigidly secured within the second end 18 of the hollow arrow shaft 15 with a portion thereof extending slightly beyond that second end 18. The arrow head member 19 then attaches to the exposed end of the arrow insert.

The first magnet member 30 and connected weight member 20 are returned to the first end 17 of the hollow arrow shaft 15 by simply inclining the tip of the arrow upward. The first magnet member 30 and connected weight member 20 slide back to the nock 40 where the first magnet member 30 engages the second magnetic attachment member 40, and is ready for relaunching the arrow.

The operation of the embodiment of the slide hammer impact enhancement system 10 with the attachment member comprising a magnetically susceptible attachment member 45 is as described above While the invention has been particularly shown and described with reference to preferred embodiments thereof, it will be understood by those skilled in the art that various changes in form and details may be made therein without departing from the spirit and scope of the invention.

We claim:

1. A slide hammer impact enhancement system adapted for incorporation into a hollow arrow shaft, the slide hammer impact enhancement system comprising:

a cylindrical, metallic weight member having a tapered end and adapted for movable positioning within a hollow arrow shaft;

a cylindrical magnet member rigidly attached to the tapered end of the weight member; and a nock member adapted for rigid mounting at a first end of the hollow arrow shaft, the nock member including an attachment member accessible from within the hollow arrow shaft;

whereby the magnet member and attached weight member within the hollow arrow shaft are maintained adjacent the nock member by the attachment member upon launching the arrow, and upon the arrow striking a target, the magnet member and attached weight member disengage from the attachment member, move down the hollow arrow shaft, and strike an arrow head at a second, opposite end thereof, thereby further driving the arrow into the target.

2. The slide hammer impact enhancement system of claim 1, wherein the weight member is fabricated from aluminum and includes a spark anodized exterior surface.

3. The slide hammer impact enhancement system of claim 1, wherein the magnet member is a rare earth magnet.

4. The slide hammer impact enhancement system of claim 1, wherein the attachment member is fabricated from a magnetically susceptible material.

5. The slide hammer impact enhancement system of claim 4, wherein the attachment member comprises a hollow structure sized to accept the cylindrical magnet member attached to the tapered end of the weight member there within.

6. The slide hammer impact enhancement system of claim 1, wherein the attachment member comprises a second magnet member accessible from within the hollow arrow shaft.

7. The slide hammer impact enhancement system of claim 6, wherein the nock member is hollow and the second magnet member is mounted within the nock member, the hollow nock member sized to accept the tapered end of the weight member and the cylindrical magnet member attached thereto.

8. A slide hammer impact enhancement system adapted for incorporation into a hollow arrow shaft, the slide hammer impact enhancement system comprising:

a cylindrical, metallic weight member having a tapered end and adapted for movable positioning within the hollow arrow shaft, the weight member fabricated from aluminum and including a spark anodized surface;

a cylindrical magnet member rigidly secured to the tapered end of the weight member; and a nock member adapted for rigid mounting at a first end of the hollow arrow shaft, the nock member including an attachment member accessible from within the hollow arrow shaft;

whereby the magnet member and attached weight member within the hollow arrow shaft are maintained adjacent the mock member within the hollow arrow shaft by the attachment member upon launching the arrow, and upon the arrow striking a target, the magnet member and attached weight member disengage from the attachment member, move down the hollow arrow shaft, and strike an arrow head at a second, opposite end thereof, thereby further driving the arrow into the target.

9. The slide hammer impact enhancement system of claim 8, wherein the attachment member is fabricated from a magnetically susceptible material.

10. The slide hammer impact enhancement system of claim 9, wherein the attachment member comprises a structure sized to accept the tapered end of the weight member and the cylindrical magnet member attached thereto.

11. The slide hammer impact enhancement system of claim 8, wherein the attachment member comprises a second magnet member accessible from within the hollow arrow shaft.

12. The slide hammer impact enhancement system of claim 11, wherein the nock member is hollow and the second magnet member is mounted within the nock member, the hollow nock member sized to accept the tapered end of the weight member and the cylindrical magnet member attached thereto.

* * * * *